US009151039B2

(12) United States Patent
Fechino

(10) Patent No.: US 9,151,039 B2
(45) Date of Patent: Oct. 6, 2015

(54) ADJUSTABLE DRIP EDGE CORNER

(71) Applicant: Mortar Net USA, Ltd., Burns Harbor (IN)

(72) Inventor: Steven Fechino, Burns Harbor, IN (US)

(73) Assignee: Mortar Net USA, Ltd., Burns Harbor, IN (US)

( * ) Notice: Subject to any disclaimer, the term of this patent is extended or adjusted under 35 U.S.C. 154(b) by 0 days.

(21) Appl. No.: 14/174,392

(22) Filed: Feb. 6, 2014

(65) Prior Publication Data

US 2014/0215931 A1 Aug. 7, 2014

Related U.S. Application Data

(60) Provisional application No. 61/761,517, filed on Feb. 6, 2013.

(51) Int. Cl.
*E04B 1/70* (2006.01)
*E04B 1/66* (2006.01)

(52) U.S. Cl.
CPC ..... *E04B 1/7038* (2013.01)

(58) Field of Classification Search
CPC ..... E04B 1/7038
USPC ..... 52/58, 61, 62, 11–16
See application file for complete search history.

(56) References Cited

U.S. PATENT DOCUMENTS 2,023,425 A * 12/1935 Larson ..... 52/408
3,838,544 A * 10/1974 Hindall ..... 52/60
4,186,531 A * 2/1980 Okolischan ..... 52/11
4,603,517 A * 8/1986 Lyons, Jr. ..... 52/60
4,635,409 A * 1/1987 Vandemore ..... 52/60
4,700,512 A * 10/1987 Laska ..... 52/58
5,072,552 A * 12/1991 Sauder ..... 52/58
5,109,641 A * 5/1992 Halan ..... 52/62
5,263,287 A * 11/1993 Lyons, Jr. ..... 52/58
5,605,019 A * 2/1997 Maziekien et al. ..... 52/58
5,706,610 A * 1/1998 Mayle ..... 52/60
5,815,986 A * 10/1998 Laska ..... 52/62
5,913,779 A * 6/1999 Edvardsen ..... 52/58
6,070,370 A * 6/2000 Locke ..... 52/58
6,199,326 B1 * 3/2001 Mayle ..... 52/58
6,401,402 B1 * 6/2002 Williams ..... 52/58
6,681,530 B1 * 1/2004 Givens ..... 52/58
6,754,993 B1 * 6/2004 Mayle et al. ..... 52/58
6,848,220 B2 * 2/2005 Faurholdt et al. ..... 52/58
8,161,689 B1 * 4/2012 Butzen ..... 52/58
8,341,897 B2 * 1/2013 Margarites ..... 52/198
2002/0124476 A1 * 9/2002 Iannelli ..... 52/11
2003/0208964 A1 * 11/2003 Batt, Sr. ..... 52/11
2005/0055890 A1 * 3/2005 Summy ..... 52/58
2005/0268561 A1 * 12/2005 Lane et al. ..... 52/58

(Continued)

*Primary Examiner* — Mark Wendell
*Assistant Examiner* — Keith Minter
(74) *Attorney, Agent, or Firm* — McDonnell, Boehnen, Hulbert & Berghoff LLP

(57) ABSTRACT

A drip edge corner element for use in masonry wall construction has a generally planar elongated member with a top side and a bottom side, with opposed side edges. This elongated member may preferable take a rectangular shape in planar profile, with a relieved section formed across the member dividing the member into two parts. These two parts are connected at a place about which the two parts are relatively movable, such as an articulable joint or pivot therebetween. The drip edge corner is thereby angularly adjustable by moving at least one of the parts about the place or pivot.

3 Claims, 3 Drawing Sheets

(56) References Cited

U.S. PATENT DOCUMENTS

| | | | | |
|---|---|---|---|---|
| 2006/0053699 | A1* | 3/2006 | Lolley et al. | 52/58 |
| 2006/0123713 | A1* | 6/2006 | Faurholdt et al. | 52/58 |
| 2006/0137263 | A1* | 6/2006 | Casey | 52/58 |
| 2009/0090068 | A1* | 4/2009 | O'rourke | 52/58 |
| 2009/0107053 | A1* | 4/2009 | Guilford | 52/12 |
| 2009/0277102 | A1* | 11/2009 | Bishop et al. | 52/58 |
| 2011/0083375 | A1* | 4/2011 | Tenute | 52/11 |
| 2011/0120025 | A1* | 5/2011 | Matthews | 52/62 |
| 2011/0185640 | A1* | 8/2011 | DeHart, Sr. | 52/11 |
| 2011/0197520 | A1* | 8/2011 | Preston | 52/58 |
| 2011/0277391 | A1* | 11/2011 | Skoretz | 52/13 |
| 2011/0277393 | A1* | 11/2011 | Hohmann, Jr. | 52/62 |
| 2012/0210654 | A1* | 8/2012 | Sexton | 52/58 |
| 2013/0014449 | A1* | 1/2013 | Rhodes | 52/11 |
| 2014/0165478 | A1* | 6/2014 | Railkar et al. | 52/58 |

* cited by examiner

ADJUSTABLE DRIP EDGE CORNER

CROSS-REFERENCE TO RELATED APPLICATIONS

The present application claims priority from U.S. application Ser. No. 61/761,517, filed Feb. 6, 2013, which is incorporated by reference herein in its entirety

FIELD OF THE INVENTION

This invention generally relates to wall constructions, such as cavity or composite wall structures, and more particularly to flashing elements which function to direct water from a wall interior to the exterior of the wall.

BACKGROUND

In the context of cavity wall structures or construction, the walls are typically formed of two wythes. These may both be of masonry, the wythes being spaced apart to form a vertical space or cavity therebetween. Alternatively it may have an outer masonry wall such as of bricks, with an inner building wall of wood, wallboard, concrete, tile or similar commonly used interior wythe materials.

In conventional cavity wall construction, flashing is typically installed atop the foundation to direct water out of the bottom of the cavity (for instance), in association with weep holes or other elements which will enable water to escape or migrate through the outer masonry wythe. Water in the cavity is undesirable for many reasons.

Flashing typically used may be in the form of a membrane, such as a rubberized material, as well as sheet metal, just to name two fairly standard types of flashing material. It is known to provide a downturned edge along the part of the flashing which will be on the outside of the outer wythe. This is referred to as a drip edge. It is also known to construct the flashing in a hybrid manner, such that a relatively flexible membrane is used in conjunction with a relatively inflexible drip edge. The flashing may ordinarily be affixed in position using adhesive, for instance.

Building corners most often meet at ninety degree angles. The flashing can be cut to size in order to meet at a ninety degree angle in these instances. Additionally, a drip edge for use in conjunction with the flashing can be provided which is pre-formed in manufacture with parts forming a ninety degree angle. However, builders and architects are not confined to easy ninety degree corners, and corners may become obtuse as well as acute in angulation.

SUMMARY

In accordance with one aspect and objective of the present invention, a drip edge corner element for use in masonry wall construction has a generally planar elongated member with a top side and a bottom side, with opposed side edges. This elongated member may preferably take a rectangular shape in planar profile, with two opposed long sides and two opposed shorter sides. A drip edge portion is formed along a side, such as one of the long sides.

A relieved section formed across the member divides the member into two parts. These two parts are connected at a place about which the two parts are relatively movable, such as an articulable joint or pivot therebetween. The drip edge corner is thereby angularly adjustable by moving at least one of the parts about the place or pivot. Accordingly, the preferred drip edge corner can be adjusted from straight (i.e., simple rectangle), through various angles. The angulation may desirably be between about 10 degrees through about 355 degrees, accommodating acute wall structures as well as obtuse wall structures.

The corner element in one form has a relieved section in the form of a notch formed in the elongate member. The notch in this embodiment has a triangular outline with a base of the notch being along one long side and an apex of the notch being near an opposed other long side. The apex of the notch does not extend completely across the member, so as to leave material of the element at the other long side. The two parts are thereby movable about the apex to change the angulation of the corner element as desired.

The foregoing embodiment of the corner element may be formed from an elongated member that is generally rectangular in initial shape with opposed long sides and opposed shorter sides forming the rectangular shape. A first triangular notch is formed along a first long side and extends to a first apex at a point toward but coming short of a second long side. A second triangular notch is formed along the second long side and extends to a second apex near but coming short of the first apex. The rectangular shape with the notches formed therein is folded along a line extending between the shorter sides and between the first and second apexes. The parts are movable about a point between the apexes.

The relieved area or areas need not be in the form of a triangle. It could be a slit. It could further take the shape of a rectangular cut-out, or a circular cutout, just to name two more kinds of relieved areas.

These and other aspects, objectives, advantages and attributes of the invention will be further understood and appreciated upon consideration of the following detailed description of embodiments of the invention, taken in conjunction with the drawings, in which.

DETAILED DESCRIPTION

The invention is described herein in an application as a corner drip edge for use in masonry construction. It could be used in other type masonry, concrete and similar building applications where a drip edge, or the like, is required.

Figure 1:
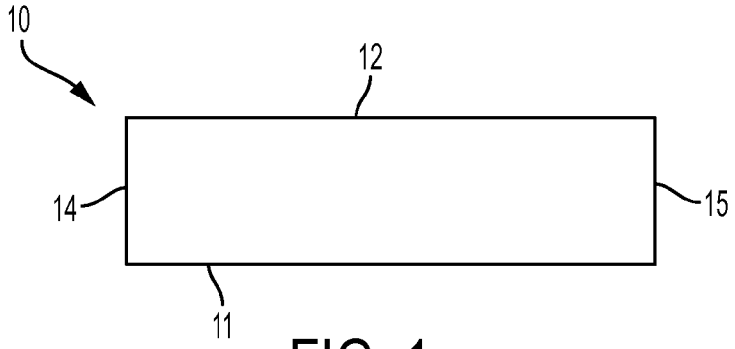
FIG. 1 is a top plan view of a rectangular form for an embodiment of the adjustable corner of this invention.

Turning now to a first embodiment, FIG. 1 shows a planar element formed into a rectangular configuration, here out of sheet metal of a type typically used in the masonry industry for flashing applications. Element 10 has two opposed long sides 11 and 12, and two shorter opposed sides 14 and 15. Element 10 may be stamped or cut to shape.

Figure 2:
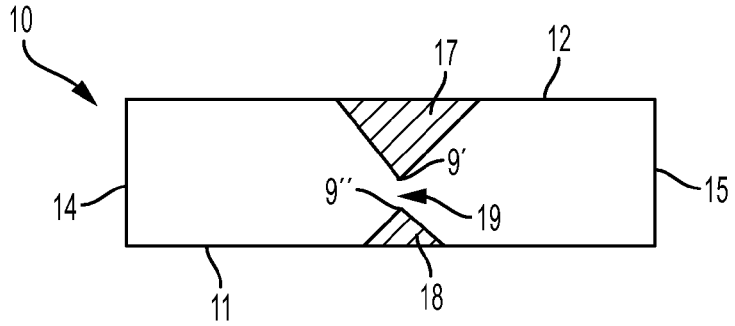
FIG. 2 is a similar view to that of FIG. 1 showing removed portions.

Turning to FIG. 2, this first embodiment has a first relieved area 17 in the form of a triangular notch, which has been cut or stamped in element 10. The base of the triangular notch is along the long side 12, with an apex a' located at a point toward the other long side 11, but stopping short of that other side. As will become apparent hereafter, the relieved area could be a simple slit, as well as other shapes for the cutout. The function of the relieved area is to enable the sides or parts of the element which it divides to be able to move relative to one another about some pivot point, as will be described.

Continuing with FIG. 2, there is a second relieved area 18 formed as a triangular cutout in the element 10. This second relieved area has its base along the other side 11, with an apex a" which extends toward the apex a', but stops short thereof. This leaves an area of material indicated at 19 between the two apexes.

With the two relieved areas 17 and 18 so formed, the element 10 is folded along a line extending from one shorter side 14 to the other shorter side 15 between the two apexes. A downturned drip edge 20 is thereby formed. This configuration can be supplied to the builder, or user, for use in a corner of a masonry construct, as for a flashing application for use as a drip edge, for instance. It would typically be used in conjunction with straight drip edge portions that would meet the shorter sides of the drip edge corner element along the foundation.

Figure 3:
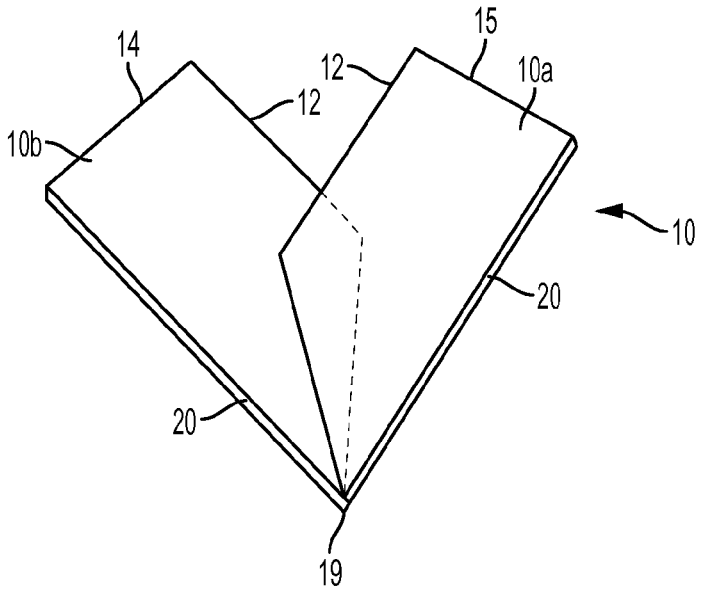
FIG. 3 is a plan view of a finished embodiment of FIGS. 1 and 2 in a first folded or adjusted configuration.

Turning to FIG. 3, the element has been divided into two parts 10*a* and 10*b*, which can articulate around the point 19. By folding the two parts relative to each other in a manner toward or actually overlapping, the drip edge corner can now be adapted for an angle that is less than 180 degrees (its original straight configuration).

Figure 4:
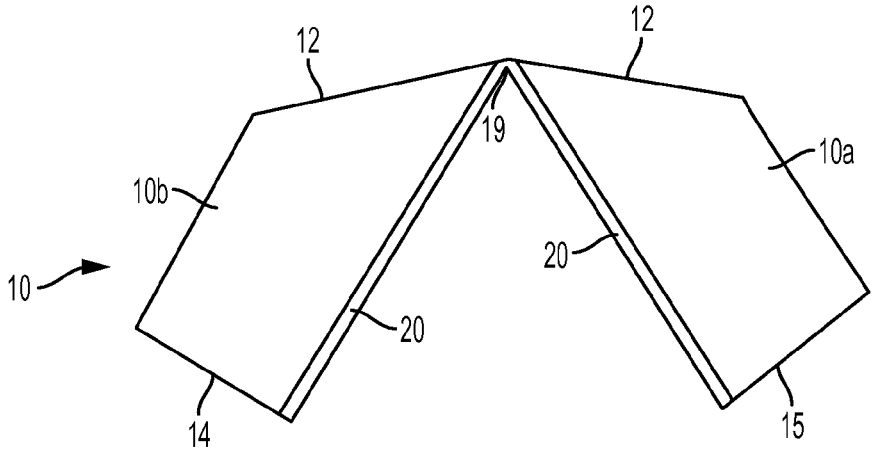
FIG. 4 is a view similar to that of FIG. 3 in a second folded or adjusted configuration.

In like manner, and as shown in FIG. 4, the two parts 10*a* and 10*b* can be moved in the other direction from that shown in FIG. 3, increases an angulation from 180 degrees.

Thus, a drip edge corner is provided that can be used to accommodate many different corner structures in a wall.

Figure 7:
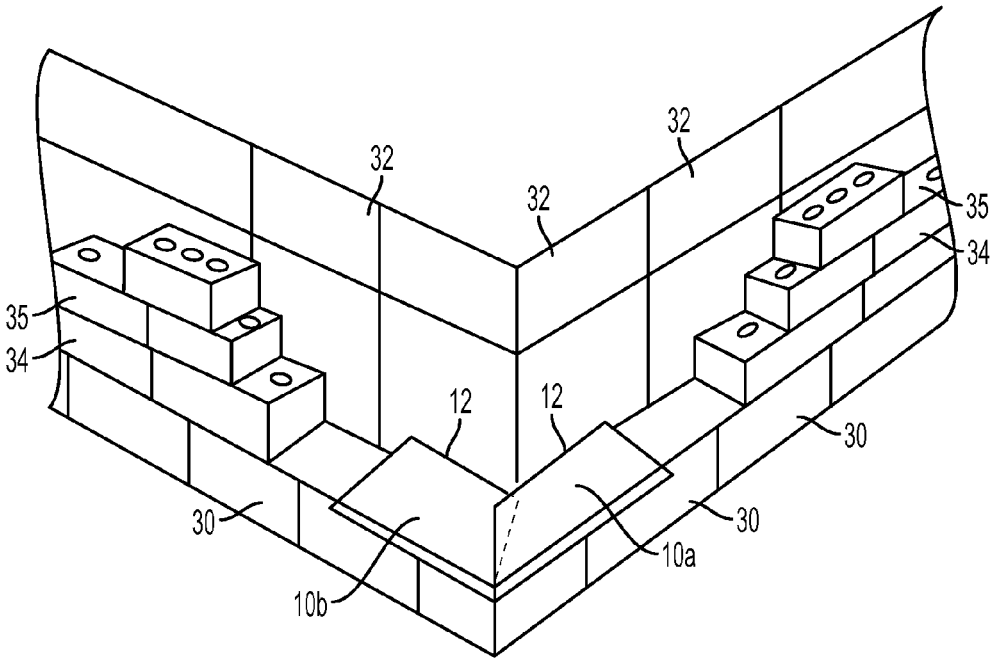
FIG. 7 shows a corner drip edge of the type shown in FIG. 3 installed in a wall corner.

FIG. 7 shows a corner drip edge of the type folded as shown in FIG. 3 installed in a wall corner. As shown here, the corner element 10 sits upon a lower course of bricks 30. Another course of bricks 34 sits upon the lower course, with another course 35 of bricks on course of bricks 34, and so on. A building inner wall structure is shown at 32, and could be a further masonry structure, or some kind of wallboard, tile, wood, concrete blocks, just to name a few possibilities. Drip edge corner 10 would be covered by and embedded between the adjacent courses of bricks where it is positioned. There would ordinarily be a gap between the bricks and the inner wall structure, in forming a cavity wall structure. A cavity wall structure generally consists of two wythes of masonry built upon a foundation. The drip edge corner would typically be used in conjunction with other flashing along the same level as the corner element, likewise preferably having a drip edge of its own.

Figure 5:
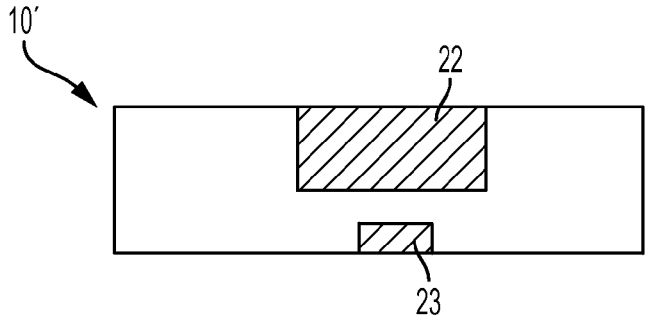
FIG. 5 is an alternative embodiment with a different removed portion arrangement.

Instead of triangular relieved areas 17 and 18, FIG. 5 shows relieved areas in the form of first and second rectangular cut-outs 22 and 23. All other aspects of the element 10' of this embodiment are the same or similar to those of the first embodiment.

Figure 6:
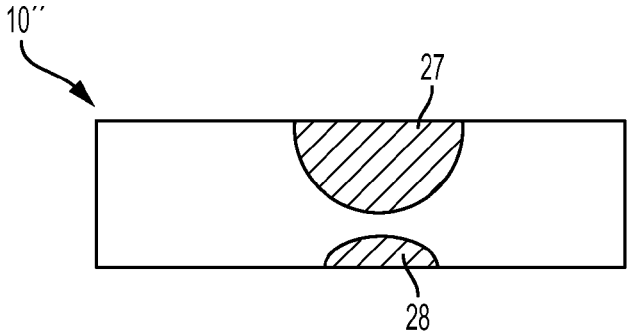
FIG. 6 is yet another alternative embodiment with still a further kind of removed portion arrangement.

FIG. 6 illustrates yet another type of relieved area shape, this time first and second semicircular cut-outs 27 and 28. All other aspects of the element 10" of this embodiment are the same or similar to those of the first embodiment.

Thus, while the invention has been described with respect to a particular embodiment or embodiments, and in one type of environment, it will be appreciated and understood that these are considered to be illustrative examples, and not limiting. Those of skill will recognize modifications, substitutions, changes and other variations which will still fall within the spirit and scope of the invention, which is as set forth in the following claims.

What is claimed is:

1. A drip edge corner element for use in masonry wall construction, comprising:

a generally planar elongated member having a top side and a bottom side with opposed side edges;

a drip edge portion formed along a side; and a relieved section formed across said member dividing said member into two parts, said parts being connected at a place about which said parts are relatively movable rotationally, said drip edge thereby being angularly adjustable by moving at least one of said parts about said place, wherein said elongated member is generally rectangular in initial shape with opposed long sides and opposed shorter sides forming said rectangular shape, a first notch formed along a first long side and extending to a first apex at a point toward but short of a second long side, a second notch formed along said second long side and extending to a second apex near but short of said first apex, said rectangular shape folded along a line extending between said shorter sides and between said first and second apexes, said parts movable about a point between said apexes.

2. The corner element of claim 1, wherein the elongated member is formed of sheet metal.

3. The corner element of claim 1, wherein said first notch and said second notch are triangular.

* * * * *